United States Patent [19]

Young

[11] 4,385,441

[45] May 31, 1983

[54] CUTTING DEVICE WITH RENEWABLE CUTTING EDGE

[76] Inventor: Donald E. Young, 3702 Homewood, Cincinnati, Ohio 45227

[21] Appl. No.: 311,036

[22] Filed: Oct. 13, 1981

Related U.S. Application Data

[63] Continuation of Ser. No. 174,449, Aug. 1, 1980, abandoned.

[51] Int. Cl.[3] ..... B26B 3/00

[52] U.S. Cl. ..... 30/314; 30/346.56; 30/355

[58] Field of Search ..... 30/314, 315, 355, 346.56

[56] References Cited

U.S. PATENT DOCUMENTS

| | | | |
|---|---|---|---|
| 1,473,546 | 11/1923 | Eiermann | 30/315 |
| 1,728,192 | 9/1929 | Wellington | 30/355 |
| 2,059,414 | 11/1936 | Taylor | 30/355 |
| 2,354,165 | 7/1944 | Williamson | 30/355 |
| 2,750,669 | 6/1956 | Hohmann | 30/355 |

FOREIGN PATENT DOCUMENTS

| | | | |
|---|---|---|---|
| 240728 | 6/1965 | Austria | 30/355 |
| 922214 | 1/1955 | Fed. Rep. of Germany | 30/355 |
| 247768 | 2/1926 | United Kingdom | 30/355 |

*Primary Examiner*—James G. Smith
*Assistant Examiner*—J. T. Zatarga
*Attorney, Agent, or Firm*—Kinney and Schenk

[57] ABSTRACT

A cutting tool is provided which permits renewable cutting edges containing teeth to be readily formed in field service.

1 Claim, 3 Drawing Figures

CUTTING DEVICE WITH RENEWABLE CUTTING EDGE

CROSS REFERENCE TO RELATED APPLICATION

This application is a continuation patent application of its copending parent patent application, Ser. No. 174,449 filed Aug. 1, 1980, now abandoned in favor of this continuation application.

BACKGROUND

The present invention relates to cutting devices and more particularly concerns a cutting blade which may be repeatedly and readily resharpened to provide cutting teeth.

In the past, substantial difficulty has been experienced in cutting or separating certain types of resistive or dulling materials. Examples of such materials are fibrous board, glass wool, insulative materials, honeycomb (metal or fiber) and plastic materials. These materials tend to dull and wear edges of cutting blades, many times ending the blade's usability.

The nature of the resistive materials makes them especially suitable for cutting surfaces with a plurality of cutting teeth. Cutting edges with teeth are, however, even more difficult to sharpen than continuous edges. Consequently, when cutting edges with teeth have been used in the past, the options remaining after the cutting edge has been dulled or damaged were severely limited. When used in field service, the user was generally relegated to disposing of the cutting blade or traveling to a facility which was equipped to sharpen the teeth.

It is therefore an object of the present invention to provide a tool with a renewable cutting edge which will readily cut or separate fibers or otherwise dulling materials.

It is a further object of the present invention to provide a cutting instrument which has a readily renewable cutting edge with cutting teeth.

It is yet another object of the present invention to provide a cutting instrument with teeth which may be readily sharpened during field service.

SUMMARY OF THE INVENTION

In accordance with the invention, a cutting device with a renewable cutting edge containing a plurality of teeth is provided. The blade of the cutting device has a cutting edge along at least one of its extremities, which extremity extends in a first predetermined direction. The blade has a plurality of parallel rows of apertures which extend completely through the blade along the blade's expanse in the first predetermined direction in generally parallel relationship with each other and with the cutting edge. Adjacent rows of the plurality of rows are offset from each other in a second direction which is substantially perpendicular to the first predetermined direction. Alternate parallel rows being in substantial alignment in the second direction. The cutting device also has a handle which is attached to the cutting blade.

According to a further aspect of the invention, a method of renewing a cutting edge on a cutting tool includes the steps of forming a cutting blade having a cutting edge along at least one of the tool's extremities which extends in a first predetermined direction with the blade having a plurality of parallel rows of apertures which extend completely through the blade along the blade's expanse in the first predetermined direction in a generally parallel relationship to the cutting edge, adjacent rows of the plurality of rows being offset from each other in a second predetermined direction which is substantially perpendicular to the first predetermined direction with alternate rows being in substantial alignment in a second direction. The method further includes the step of removing a portion of the cutting edge of the blade material to partially open the apertures of one of the rows. A more specific method further includes the step of utilizing the cutting edge to sever material and thereafter removing an additional portion of the cutting edge of the blade to partially open the apertures of another one of the parallel rows. Preferably, the blade material is removed by grinding.

BRIEF DESCRIPTION OF THE DRAWINGS

Other objects and advantages of the invention will become apparent upon reading the following detailed description and upon reference to the drawings, in which.

While the invention will be described in connection with a preferred embodiment and procedure, it will be understood that it does not intend to limit the invention to that embodiment or procedure. On the contrary, it is intended to cover all alternatives, modifications and equivalents as may be included within the spirit and scope of the invention as defined by the appended claims.

DETAILED DESCRIPTION OF THE PREFERRED EMBODIMENT

Figure 1:
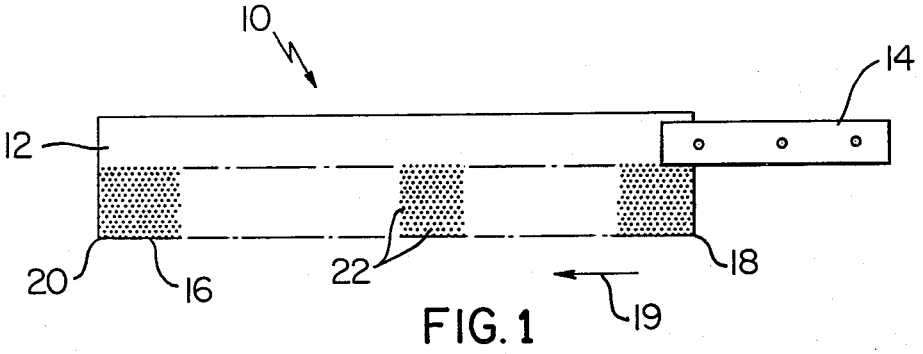
FIG. 1 is a side elevational view of a cutting instrument using one embodiment of the present invention.
Figure 2:
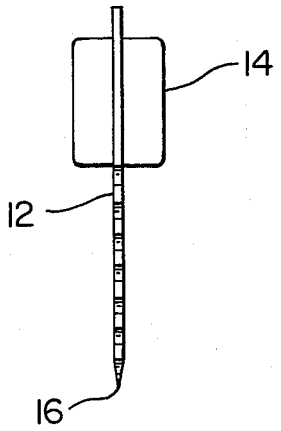
FIG. 2 is an end view of the cutting instrument illustrated in FIG. 1.

Referring now to the drawings and to FIG. 1 in particular, a cutting instrument made in accordance to the present invention is illustrated and generally designated by the numeral 10. The instrument, in the form of a knife, includes a cutting blade 12 formed of metal to which a handle 14 is secured. The illustrated handle 14 is only one of many various well types of handles which may be used with the invention, as will be readily appreciated by those skilled in the art.

The blade 12 has a cutting edge 16 which extends along a part of the expanse of cutting blade's 12 extremity in a first predetermined direction, indicated by arrow 19, between edge ends or corners 18 and 20. The cutting edge 16 is comprised of a plurality of adjacent arcuate open sided openings 22 which extend along the edge 16 between corners 18 and 20. These arcuate open sided openings 22 are shown in greater detail in FIG. 3.

Disposed inwardly of the cutting edge 16 and the arcuate openings 22 are a multitude of parallel rows of apertures with external completely through the blade 12, six rows, 24, 26, 28, 30, 32 and 34 being specifically numbered in the illustration. In the preferred embodiment, these apertures are circular in configuration. Other configurations, such as diamond shaped apertures, could be utilized, however. These parallel rows of apertures (24, 26, 28, 30, 32 and 34) are in general parallel relationship with each other and with the cutting edge 16 and the arcuate openings 22.

Figure 3:
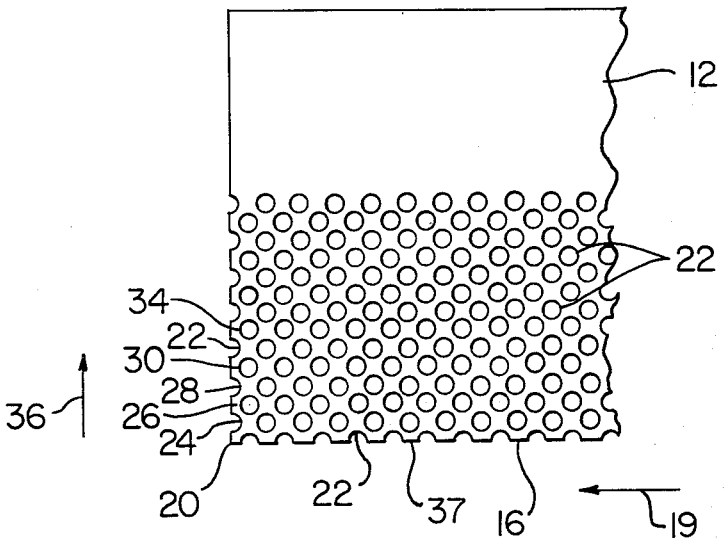
FIG. 3 is an enlarged schematic fragmentary view of the edge of the cutting blade of the cutting instrument of the embodiment of FIG. 1.

Adjacent rows (24, 26, 28, 30, 32 and 34) of the apertures are spaced from each other in a second predetermined direction, indicated by arrow 36, substantially perpendicular to the first predetermined direction. In this second predetermined direction, alternate parallel rows are in alignment with each other. In other words, the centers of the apertures in rows 24, 28, and 32 are in alignment with each other in a second predetermined direction, indicated by arrow 36. On the other hand, adjacent rows of apertures, for example, rows 24 and 26, are offset from each other in such a manner that an imaginary line joining the centers of the apertures in alternate rows would bisect the centers of each adjacent row. The depiction of FIG. 3 illustrates such imaginary lines connecting the aperture centers.

In some instances, it may be desirable to position the apertures in the second predetermined direction (represented by arrow 36) such that in that direction, the lower extremity of the aperture in a row would extend beyond the upper extremity of the aperture in the adjacent row immediately therebeneath. In other words, for the apertures in row 26 to have a directional extension (in the direction of arrow 36) toward the adjacent row 28 which overlaps with the directional extension of the apertures in row 28 in the direction opposite that depicted by arrow 36. In the preferred embodiment this condition is not completely met but only approximated. If the above condition is fully met, it would be impossible to remove any amount of material from the edge 16 without forming teeth such as that shown at 37 in FIG. 3. In the preferred form, it would be possible to remove a precise amount of material from the edge 16 to form a continuous edge without forming teeth such as that at 37. The preferred form of merely approximating the above identified condition results in greater strength for the cutting blade, without significantly altering the blade's capability for readily renewing a cutting blade with cutting teeth.

As should be apparent from the above, the illustrated cutting blade 12 may be readily sharpened in the field to provide a new set of sharpened teeth 37. When used upon the fiberous or otherwise resistive materials of the type previously described, the cutting edge of cutting blade 12 may be readily ground after initial use to remove blade material in the vicinity of the cutting edge 16. As the existing (and presumably dulled) edge is removed by simple grinding, the adjacent row of apertures (in the direction of arrow 36) is opened, and these open apertures form ripping edges which take the form of teeth 37 as illustrated in FIG. 3.

Thus it is apparent that there has been provided, in accordance with the invention, a method and apparatus that fully satisfies the objects, aims, and advantages set forth above. While the invention has been described in conjunction with a specific embodiment thereof, it is evident that many alternatives, modifications, and variations will be apparent to those skilled in the art in light of the foregoing description. Accordingly, it is intended to embrace all such alternatives, modifications, and variations as fall within the spirit and broad scope of the appending claims.

What is claimed is:

1. A cutting device with a renewable substantially straight line cutting edge containing a plurality of teeth, comprising:

a cutting blade, said blade having a substantially straight line cutting edge along at least one of its extremities which extends in a first predetermined direction, said blade having a plurality of parallel rows of like circular apertures which extend through the blade along the blade's expanse in the first predetermined direction in generally parallel relationship to said cutting edge, adjacent rows of said plurality of rows being offset from each other in a second direction substantially perpendicular to said first predetermined direction with alternate rows being in substantial alignment in said second direction, each circular aperture having a diameter thereof substantially equal to the diameters of the other apertures, adjacent apertures in each row thereof being spaced from each other approximately the same distance as the length of said diameter of each said aperture and adjacent aligned apertures in said alternate rows of said apertures being spaced from each other approximately the same distance as the length of said diameter of each said aperture, said cutting edge being defined by one of said rows of apertures being opened along a substantially straight line to provide said plurality of teeth on said cutting edge, wherein said blade has another substantially straight line cutting edge along another of its extremities, said other cutting edge being substantially perpendicular to the first-mentioned cutting edge and containing a plurality of teeth defined by opened aligned apertures in said alternate rows; and a handle attached to said cutting blade.

* * * * *